US007338711B1

(12) United States Patent
Brousseau, III

(10) Patent No.: US 7,338,711 B1
(45) Date of Patent: Mar. 4, 2008

(54) ENHANCED NANOCOMPOSITE COMBUSTION ACCELERANT AND METHODS FOR MAKING THE SAME

(75) Inventor: Louis Brousseau, III, Austin, TX (US)

(73) Assignee: Quantum Logic Devices, Inc., Austin, TX (US)

( * ) Notice: Subject to any disclaimer, the term of this patent is extended or adjusted under 35 U.S.C. 154(b) by 429 days.

(21) Appl. No.: 10/639,669

(22) Filed: Aug. 12, 2003

Related U.S. Application Data

(60) Provisional application No. 60/402,660, filed on Aug. 12, 2002.

(51) Int. Cl.
*B32B 5/16* (2006.01)
*C06B 45/18* (2006.01)

(52) U.S. Cl. ..... 428/403; 149/3; 149/29; 149/108.2; 977/773

(58) Field of Classification Search ..... 428/403, 428/407; 149/3, 29, 108.2; 977/773
See application file for complete search history.

(56) References Cited

U.S. PATENT DOCUMENTS 4,637,847 A 1/1987 Nieder
5,891,548 A * 4/1999 Graiver et al. ..... 428/98
6,177,088 B1 * 1/2001 Guo et al. ..... 424/400
6,436,305 B1 8/2002 Schulz et al.
6,531,304 B1 3/2003 Bonnemann et al.
6,649,138 B2 * 11/2003 Adams et al. ..... 423/403
6,652,682 B1 * 11/2003 Fawls et al. ..... 149/22
6,797,380 B2 * 9/2004 Bonitatebus et al. .... 428/842.2
6,984,274 B2 * 1/2006 Hofmann et al. ..... 149/2
7,025,840 B1 * 4/2006 Adams ..... 149/108.2

OTHER PUBLICATIONS

Armstrong, et al., "Enhanced Propellant Combustion with Nanoparticles," *Nano Letters*, vol. 0, No. 0, A-C (2002).
Chen and Sommers, "Alkanethiolate-Protected Copper Nanoparticles: Spectroscopy, Electrochemistry, and Solid-State Morphological Evolution," *J. Phys. Chem. B* 105:8816-8820 (2001) [2001 American Chemical Society—Published on Web Jul. 27, 2001].
Goetting, et al., "Microcontact Printing of Alkanephosphonic Acids on Aluminum: Patterns Transfer by Wet Chemical Etching," *Langmuir* 15:1182-1191 (1999) [1999 American Chemical Society—Published on Web Jan. 13, 1999].
Kataby, et al., "Coating Carboxylic Acids on Amorphous Iron Nanoparticles," *Langmuir* 15:1703-1708 (1999) [1999 American Chemical Society—Published on Web Feb. 3, 1999].
Wolfgang J. Sievert, "Preparation and Characterisation of Buffered Oxide Etchants," *Semiconductor Fabtech*—8th Edition: 135-138.

* cited by examiner

*Primary Examiner*—Holly T Le
(74) *Attorney, Agent, or Firm*—Vinson Elkins, LLP

(57) ABSTRACT

Nanoparticles having designed or engineered coatings that provide enhanced or improved characteristics to the coated nanoparticles and methods for forming the improved nanoparticles from oxide or ceramic coated nanoparticles.

40 Claims, 5 Drawing Sheets

ENHANCED NANOCOMPOSITE COMBUSTION ACCELERANT AND METHODS FOR MAKING THE SAME

CROSS-REFERENCE TO RELATED APPLICATIONS

This application claims the benefit of, and incorporates herein by reference, the following United States Provisional Application: U.S. Provisional Application No. 60/402,660, filed Aug. 12, 2002

FIELD OF THE INVENTION

This invention generally relates to reactive nanoparticles and more particularly to the production and use of reactive nanoparticles with reactive compositions.

BACKGROUND OF THE INVENTION

Reactive metal nanoparticles may be used to accelerate or catalyze the combustion of fuels and/or explosives. For instance, reactive nanoparticles can be added to solid rocket propellants or to high-energy explosives to increase the amount of heat generated and energy released during combustion of the nanoparticle containing fuel and/or explosive. Typically, a small quantity of reactive nanoparticles can be mixed with a fuel, explosive, and/or other major component to form an energy releasing composition. The nanoparticles provide an enhanced reaction rate to the composition due to the enormous amounts of heat generated at a local level as the nanoparticles react with oxygen during combustion of the composition. The energy release provided by the nanoparticles increases the reaction rate of the composition, providing increased energy or heat to the reaction.

Typical reactive nanoparticles used to form reactive compositions include aluminum and molybdenum. Other reactive metal particles, such as zirconium, silicon, phosphorous, boron, sodium, magnesium, titanium, and potassium may also be used to form nanoparticles for use with reactive compositions.

The reactivity of nanoparticles used in the formation of reactive compositions poses problems in the production of such compositions because the nanoparticles are typically instable or reactive to the atmosphere. To counter the innate reactivity of the nanoparticles, the nanoparticles used to produce reactive compositions are typically coated with metal oxide surface coatings, which protect the nanoparticle from reaction with air. Metal oxides can be formed on a nanoparticle when the nanoparticle is exposed to oxygen. For example, nanoparticles may be exposed to an oxygen environment during manufacture to create a metal oxide passivation layer on the nanoparticles. Metal oxides can also form on nanoparticles from exposure to air or oxygen such as occurs over time during long-term storage of the nanoparticles.

Protective metal oxide surface coatings may consume up to 50 percent or more of the mass of a nanoparticle. The metal oxide portion of a metal oxide passivated nanoparticle is non-reactive and does not contribute to an increased energy or heat release upon combustion of the reactive composition employing the reactive nanoparticles. The overall energy per unit mass gain obtained by adding reactive nanoparticles to a reactive composition is thereby reduced by the mass of the metal oxide coating. The presence of the unreactive metal oxide in a reactive composition can also slow the rate of reaction of the composition or hinder the efficiency of a reaction of the composition.

Another drawback to the use of metal oxide coated reactive nanoparticles in reactive compositions is the fact that the oxide-coated nanoparticles often fail to disperse evenly in a reactive composition. For example, the hydrophobic nature of organic fuels such as gasoline and plastic explosives tends to encourage uneven distribution of oxide-coated nanoparticles in such fuels. The uneven distribution of reactive nanoparticles throughout the fuel can result in an uneven burn rate within the mass of fuel, with "hot spots" that burn faster due to locally higher concentrations of nanoparticles and "cold spots" that burn slower due to locally lower concentrations of nanoparticles.

Alternatives to metal oxide layers have been proposed as passivation coatings for reactive nanoparticles used with reactive compositions. For instance, reactive nanoparticles have been coated with polymers. Polymer coatings, however, can coat the particles unevenly, leaving pores and gaps through which oxygen can reach the reactive metal and form oxides on the surface of the coated nanoparticle. In addition, the polymer chains must be broken during reaction, which consumes energy from the reaction, and longer polymer chains require a greater amount of energy disengage from the nanoparticle. Thus, the thermal stability of the polymer chains becomes detrimental to the reaction because too much energy is consumed breaking the polymer chains to reach the nanoparticles.

Organic molecular monolayers have also been studied as passivation coatings for reactive nanoparticles. Such layers provide good stability against oxidation, impact sensitivity, and particle agglomeration. Organic molecular monlayer covered nanoparticles also retain good dispersion properties in fuel, propellant, and explosive composites.

Other coatings that have been proposed as passivation coatings for reactive metal nanoparticles include ceramics and alloys, such as inorganic salts or metals. For example, pyrolytic methods for producing reactive metal nanoparticles that simultaneously deposit a thin layer of sodium chloride on their surface to protect the particles from the atmosphere have been reported. In other instances, a thin film of gold has been used to protect magnetic iron particles from oxidation.

Although alternative reactive nanoparticle passivation coatings may be used in place of oxide coatings, these coatings can still incur some of the same downfalls as the oxide coatings. Surface oxides, ceramic coatings, inorganic coatings, organic polymer coatings, and alloy coatings can be extremely resistant to corrosion and/or combustion, thereby presenting a barrier to initiation of a reaction with the reactive portion of the nanoparticle. These alternative coatings also reduce the mass to energy ratio of the nanoparticles because the coatings are unreactive. Combustion rates with the alternative coatings can also be reduced due to the thermal stability of the coatings or resistance of the coatings to reaction.

Therefore, improved reactive nanoparticle passivation coatings that alleviate at least some of the problems of the currently available reactive nanoparticle passivation coatings are desirable.

SUMMARY OF THE INVENTION

Embodiments of the present invention provide coated nanoparticles that may be used with reactive compositions, such as in fuels, propellants, and explosive compositions.

According to some embodiments, the nanoparticle coatings may be designed or engineered to provide desired characteristics to the coated nanoparticles. In other embodiments, processes are provided to remove undesirable nanoparticle coatings and replace the removed coatings with a new, more desirable coating.

According to embodiments of the present invention a nanoparticle coating may be engineered to promote the mixing of the coated nanoparticle within a reactive composition. The coating for the nanoparticle may be selected such that the coated nanoparticle will disperse evenly throughout a reactive composition. For example, polar coatings may be used to coat nanoparticles being added to a polar reactive composition in order to promote even dispersion or suspension of the coated nanoparticles in the reactive composition.

In other embodiments of the present invention the nanoparticle coatings may act as a fuel, propellant, explosive, or other energy releasing compound. The use of such coatings to passivate the nanoparticles provides additional energy to a reactive composition, thereby increasing the energy density of the coated nanoparticles over the coated nanoparticles available in the prior art.

Embodiments of the present invention also provide nanoparticle coatings that are engineered to release reactive species upon combustion. For instance, compounds that release a singlet oxygen upon combustion may be used as the nanoparticle coatings. When combusted, the released singlet oxygen reacts with the portions of the reactive composition and provides additional energy to the system. Thus, the amount of energy provided by the coated nanoparticle according to the present invention is greater than that of an oxide coating.

In other embodiments of the present invention the nanoparticle coatings are designed to be sensitive to a light source or energy source. The sensitivity of the nanoparticle coating to the light source allows radiation-induced reaction initiation of the coated nanoparticle. For instance, photoinitiators may be incorporated into the nanoparticle coating such that upon exposure to a particular wavelength of light the coating reacts and triggers the reaction of the nanoparticle or reactive composition in which coated nanoparticles are suspended.

According to other embodiments, the nanoparticle coatings are engineered to release from the nanoparticle at particular temperatures or under specific conditions. The coatings may be selected based upon binding properties with the nanoparticles to provide a nanoparticle coating that will decompose or disassociate from the nanoparticle under particular conditions.

In still other embodiments of the invention, processes for removing a coating from a nanoparticle and applying a new coating to the nanoparticle are provided. According to these embodiments, a nanoparticle coated with an oxide, inorganic salt, alloy, or other passivation coating is exposed to an etching solution capable of etching the passivation coating from the nanoparticle. Preferably, the etching solution will not etch the nanoparticle itself. The etching solution may also include specific ligands for coating the etched nanoparticles. Once the passivation coating is etched from the nanoparticle, a new coating is formed on the nanoparticle from the ligands in the etching solution. Other coating materials may also be included in the etching solution to form coatings according to the present invention on the etched nanoparticles.

Coated nanoparticles according to the present invention can provide increased energy densities and improved characteristics to the reactive compositions in which they are mixed. For example, the nanoparticle is primarily in the form of a metal having virtually no metal oxide, thereby providing the maximum amount of reactive metal per coated nanoparticle. The coating may also have a lower weight than other passivation coatings, providing a higher energy density or energy per mass than such coated particles. The coatings can also be designed to burn as additional fuel during combustion or as an explosive. The coatings can include oxygen that is released during combustion, thereby accelerating the reaction of the nanoparticle or reactive composition the nanoparticle is in. The coated nanoparticles can also be engineered to have similar hydrophobicity to reactive compositions such as fuels, propellants, and explosives, such that the coated nanoparticles disperse evenly within the reactive composition. The coatings may also be photoreactive or sensitive to particular temperatures or conditions, providing different mechanisms for initiating the reaction of the coated nanoparticles.

BRIEF DESCRIPTION OF THE DRAWING FIGURES

The invention can be more readily ascertained from the following description of the invention when read in conjunction with the accompanying drawings in which.

DETAILED DESCRIPTION OF THE INVENTION

Figure 1:
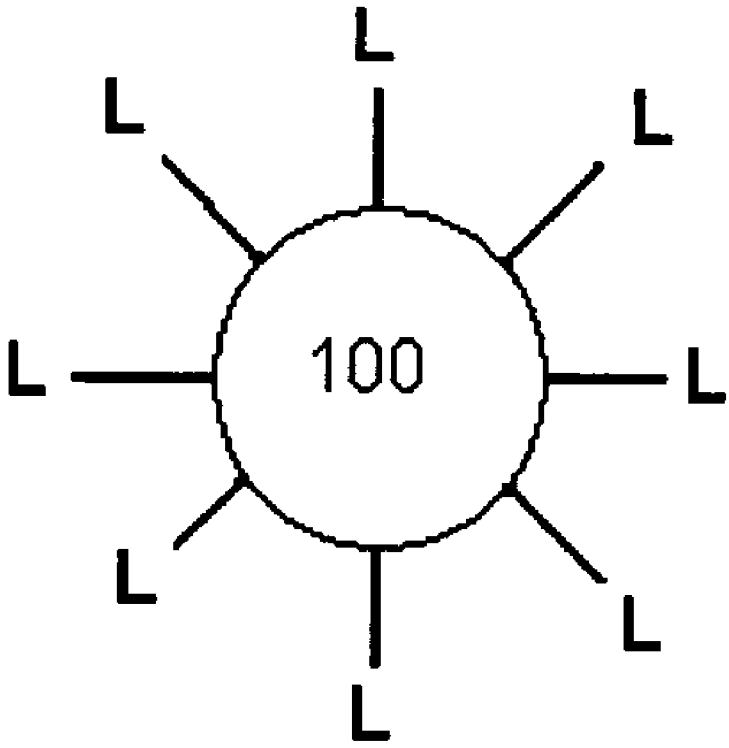
FIG. 1 illustrates a nanoparticle coated with ligands according to embodiments of the present invention.

The present invention now will be described more fully hereinafter with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout.

Embodiments of the present invention relate to nanoparticles and more particularly to improved passivation coatings for reactive nanoparticles and methods of forming such passivation coatings on reactive nanoparticles. Nanoparticles formed according to embodiments of the present invention may be used with fuels, explosives, and/or other reactive compositions.

Nanoparticles may be used with reactive compositions to promote the reactivity of the composition or to facilitate the reaction of the composition. Typically, nanoparticles are reactive species, such as reactive metals. For example, reactive metal nanoparticles include metals such as zirconium, silicon, aluminum, phosphorous, boron, sodium, magnesium, titanium, and potassium. These, and other reactive nanoparticles may be used with the embodiments of the present invention.

According to various embodiments of the present invention, nanoparticle coatings may be custom engineered to produce particular characteristics. The performance of nanoparticle containing reactive compositions may be improved by engineering advantageous properties and/or characteristics into passivation coatings of at least a portion of the reactive nanoparticles included in such reactive compositions.

The formation of coatings on a nanoparticle may be accomplished using various techniques. For example, nanoparticles may be mixed in a solution containing coating molecules to promote the coating of the nanoparticle. Alternatively, coatings may be applied to nanoparticles by exposing the nanoparticles to a vapor phase of the coating material such that the coating attaches to or bonds with the nanoparticle. In either case, coatings attach to a nanoparticle through covalent bonding. Coatings are formed by the attachment of ligands or other organic molecules to the surface of the nanoparticle. According to embodiments of the present invention, the ligands include a functional group or end that is attracted to the nanoparticle. The functional groups of the ligands (L) attach to the nanoparticle 100 and form a coating about the nanoparticle 100 as illustrated in FIG. 1. For example, the sulfur end of a thiol molecule will covalently bond to most metal nanoparticles. Therefore, a ligand having a sulfur end of a thiol molecule may be used as a nanoparticle coating. Other functional groups include, but are not limited to, thiols, alcohols, nitro compounds, phosphines, phosphine oxides, selenides, phosphinic acids, phosphonic acids, sulfonic acids, sulfonates, carboxylic acids, disulfides, peroxides, amines, nitriles, isonitriles, thionitiles, oxynitriles, oxysilanes, alkanes, alkenes, alkynes, aromatic compounds, and seleno moieties. The strength of the affinity of a particular functional group can vary from metal to metal.

Figure 2:
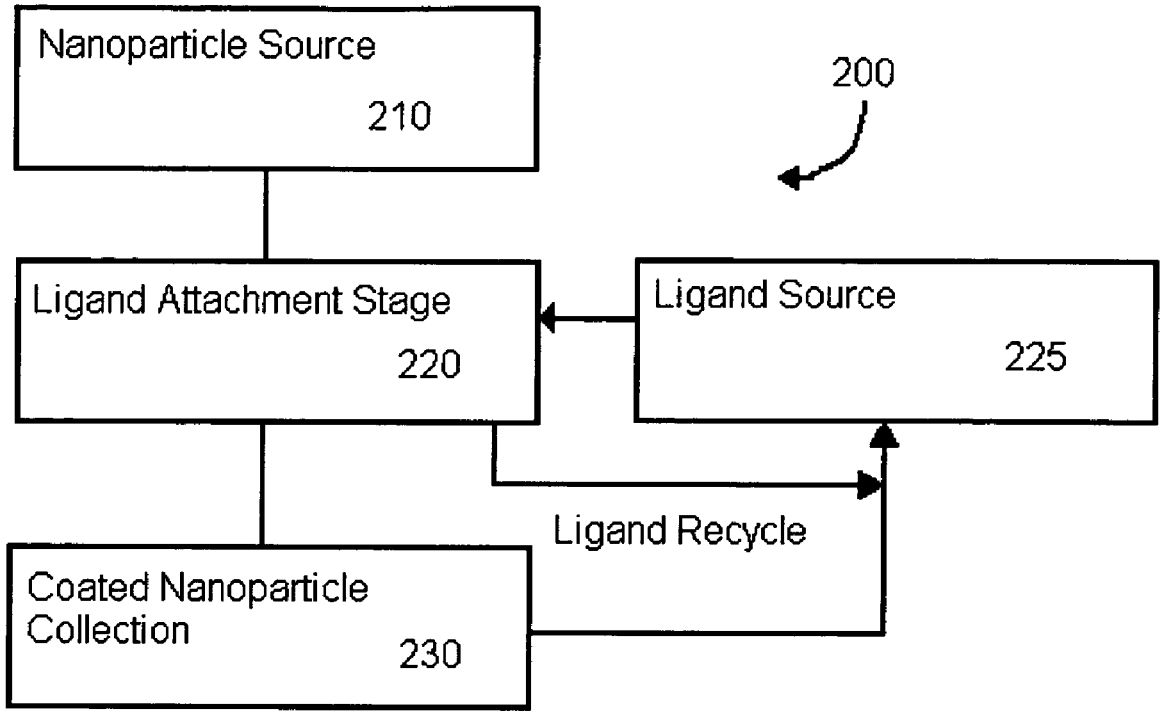
FIG. 2 illustrates a process flow diagram of a nanoparticle coating process according to embodiments of the present invention.

An example of a nanoparticle coating process 200 according to embodiments of the present invention is illustrated in FIG. 2. Nanoparticles from a nanoparticle source 210 are fed to a ligand attachment stage 220. A ligand source 225 supplies ligand particles to the ligand attachment stage 220, where the ligand particles bond to the nanoparticles to form a coated nanoparticle according to embodiments of the present invention. Coated nanoparticles may be removed or separated from the product of the ligand attachment stage 230 in a coated nanoparticle collection stage 230. Excess ligand may be collected from either the ligand attachment stage 220 or the coated nanoparticle collection stage 230 and recycled within the process.

The ligand attachment stage 220 may include solution processes where the nanoparticles and ligands are added to a solution for combination. For example, ligands may be suspended in a solution in the ligand attachment stage 220. Nanoparticles may be suspended in the solution where the ligands are able to attach to the nanoparticles, thereby forming a ligand coated nanoparticle. Portions of the solution from the ligand attachment stage 220 with suspended coated nanoparticles and excess ligand are fed to a coated nanoparticle separation stage 230 where the coated nanoparticles are separated from the solution. Separation may be accomplished using one of many different techniques for separating particles from solutions, including, but not limited to, filtration, gravitational separation, and centrifugation. The collected coated nanoparticles may also be dried, such as under a vacuum or flowing carrier gas. Excess ligands collected from the coated nanoparticle collection stage 230 or the ligand attachment stage 220 may be recycled within the process.

Alternatively, the ligand attachment stage 220 may include a vapor attachment process. For example, nanoparticles suspended in an inert carrier gas, such as argon or nitrogen, may pass through a vapor of the ligand within the ligand attachment stage 220. Known vaporization processes may be used to produce the ligand vapor. As the nanoparticles pass through the ligand vapor the ligands spontaneously attach to the nanoparticle surface forming the desired ligand coating. The coated nanoparticles are then collected.

In certain embodiments of the present invention a nanoparticle coating may provide improved mixing capabilities for the coated nanoparticle in a reactive composition. The improved mixing capabilities result from a molecular coating applied to the nanoparticles. The molecular coating is selected based upon the other components of the reactive composition such that coated nanoparticles can be suspended in a matrix of the reactive composition.

Typical oxide and ceramic coatings tend to aggregate together due to the segregation of the polar nanoparticle coating surface and the non-polar reactive composition matrix. In order to avoid such separation in nanoparticle containing reactive compositions, molecular coatings having similar charges or free energy may be applied to the nanoparticles. According to embodiments of the present invention the molecular coating for a nanoparticle is selected to be compatible and mixable with the overall reactive composition. Preferably, the molecular coating is selected such that an equal dispersion of coated nanoparticles in a reactive composition is achieved, which avoid problems associated with "hot spots" or "cold spots" in the reactive composition.

The selection of a coating for a nanoparticle can be based upon the characteristics of the reactive composition desired. For instance, if the reactive composition is a polar composition the molecular coating selected for the nanoparticles used with the reactive composition is also polar. Similarly, if a non-polar reactive composition is desired the preferable nanoparticle coating is non-polar so that the coated nanoparticles will evenly distribute in the reactive composition. The selection of a nanoparticle coating may depend upon the matching of the free energy of the nanoparticle coating to that of the other components of the desired reactive composition. For example, aluminum nanoparticles may be coated with 1-dodecanethiol monolayers and dispersed in non-polar solvent. The non-polar nature of the 1-dodecanethiol monolayers allows the ready dispersion of the coated nanoparticles into liquid fuels such as heptane, propanol, and diethyl ether to form reactive compositions having finely-divided colloidal suspensions that do not settle out over time.

In certain embodiments, the molecular coating may be selected to be the same as that of the matrix of the reactive composition. For example, a particle may be coated with a thiol-functionalized form of trinitrotoluene (TNT)—such as 3,5-dinitro-thiophenol—that will allow even dispersion of the particles into a composite of TNT.

According to other embodiments of the present invention a molecular nanoparticle coating may be engineered such that the coating itself acts as a fuel, explosive, propellant, catalyst, or energy releasing component of a reactive composition. Such coatings can provide energy to the system, resulting in an overall energy density increase for the reactive composition.

Nanoparticles are typically added to reactive compositions to increase the energy or heat generation of the reactive composition upon activation. The reactive nanoparticle provides the desired energy or heat increase. However, traditional nanoparticle coatings—such as oxides, polymers, and ceramics—require the expenditure of energy to separate the coating from the nanoparticle thereby reducing the amount of energy produced by the reactive composition because some of the generated energy is consumed to expose the nanoparticles to the reaction. The reduction in energy caused by the consumption of a nanoparticle coating is undesirable.

A nanoparticle coating engineered to include a fuel, explosive, propellant, or other energy releasing agent reduces or eliminates energy consumption required to expose the nanoparticles in a reactive composition. Furthermore, such nanoparticle coatings can increase the amount of energy produced in a reaction involving the coatings. For example, it is well known that azide compounds, which are used as air-bag inflators and detonators, are explosive. Upon combustion, nitrogen atoms of an azide moiety react to produce nitrogen oxides. This reaction produces heat. The inclusion of azides in a nanoparticle coating can produce the same heat or energy. The combustion of azides in a reactive composition containing nanoparticles coated with azides, produces heat or releases energy. Thus, energy is added to the overall reaction rather than consumed by the reaction.

Other compounds can also be used as coatings for nanoparticles. For instance, nitro-group containing compounds such as TNT, Tetryl, RDX (cyclotrimethylenetrinitramine), and PETN (pentaerythritol tetranitrate) can be used. Other explosive compounds may also be used as molecular coatings, for instance, azide compounds, peroxides, and alkynes. The coating compounds may be attached to the nanoparticles as ligands or as modifiers incorporated with a binding group, such as a thiol.

Molecular coatings for nanoparticles can also be engineered to release reactive species upon combustion, providing the reaction with increased energy release. According to embodiments of the present invention, moieties that release reactive species upon combustion may be incorporated into the nanoparticle coatings, such as radical organics, oxygen, or hydrogen. For example, when combusted, peroxides release a singlet oxygen. The inclusion of peroxides in a nanoparticle coating results in the release of singlet oxygen into the reactive composition during combustion. The singlet oxygen is highly reactive and rapidly reacts with exposed nanoparticle surfaces or other combustible elements of the reactive composition. The additional reaction caused by the release of the singlet oxygen boosts the released energy in the system, thereby increasing the amount of energy per mass of the reactive composition. Other moieties that may be incorporated in the coatings to release reactive species include azides, nitrogen oxides, and superoxides.

According to other embodiments of the present invention the nanoparticle coatings can be designed to initiate the reaction of the reactive composition. Light or energy sensitive coatings may be used a nanoparticle coatings. Upon exposure to a particular wavelength of light or quantity of energy the coating may react, thereby initiating or promoting the reaction of the nanoparticles and reactive composition containing the coated nanoparticles. For example, irradiation of 2,2'-azobisisobutyronitrile by ultraviolet light releases isobutyronitrile radicals which subsequently attack other constituents of the composite to accelerate reaction.

Photoreactive nanoparticles can be formed by incorporating photoinitiators into a nanoparticle coating. The photoinitiators may be selected such that they are reactive to a particular wavelength of light or a particular amount of energy. The photoinitiators can be added to a coating material and incorporated into the nanoparticle. Reaction of photoreactive nanoparticle coatings in a reactive composition may be triggered by exposure of the reactive composition to an energy source or a wavelength of light. Such exposure triggers a reaction in the photoreactive coating that produces a secondary reactive species capable of initiating the reaction of the nanoparticles and the reactive composition. For example, a nanoparticle coating may be selected that is reactive to a particular laser. A nanoparticle coated with the selected coating will react upon exposure to the particular laser. Thus, a reaction of the nanoparticles and/or a reactive composition containing the photoreactive coated nanoparticles may be initiated from a distance using a laser.

Examples of photoinitiators that may be incorporated with nanoparticle coatings according to embodiments of the present invention include azides, peroxides, carboxylic acid anhydrides, ethenyl-amine compounds, ruthenium bipyridine complexes, coumarin dyes, or other ultra-violet or visible light activated initiators known in the art. Photoacid generators, which produce reactive hydrogen cations (i.e. protons), may also be incorporated with nanoparticle coatings according to embodiments of the present invention.

According to other embodiments of the present invention nanoparticle coatings can be designed or engineered such that the coating only exposes the reactive nanoparticle surface or causes a reaction upon exposure to a specific temperature and/or under specific conditions. Control of the overall strength of adsorption of the coating to the surface of the nanoparticle can be accomplished by the selection of the binding moiety in combination with intermolecular forces that stabilize the coating layer. Coating moieties that have a stronger affinity for the surface of the nanoparticle will be released at higher temperatures, whereas ones with weaker affinity will be released at lower temperatures. The affinity series, or order of weak to strong binding moieties, depends upon the identity of the reactive nanoparticle. For example, binding to aluminum nanoparticles will decrease along the series of O>S>N>P>Se. Other nanoparticle compositions may have the same or different series of affinity attractions. Further, moieties that have multiple atoms with affinity for the nanoparticles produce stronger bonds in direct proportion to the number of atoms present. For example, carboxylic acid produces a stronger bond than alcohol, providing for further tuning of the binding strength within a given "family" of molecules. Certain affinity groups, such as those with multiple oxygen atoms (i.e. carboxcylic acids, oxysilanes, phosphates, and the like) can form polymeric metal-oxygen layers at the particle surface that provide exceptional strength of binding interaction and can be extraordinarily difficult to remove. These compounds will have the highest desorption temperatures.

Molecular monolayer coatings may also be stabilized by van Der Waals forces and other intermolecular attractive forces between individual molecules in the layer, which can impact the desorption temperature and/or pressure of the coating. For example, molecules containing aromatic rings that can engage in pi-pi stacking of the molecular orbital systems of adjacent molecules will release at higher temperatures than a coating without such interactions. Other molecular properties that depend on intermolecular forces, such as solubility and vapor pressure, can also be predictive.

In still other embodiments of the present invention, nanoparticles with traditional coatings such as oxides, ceramics, polymers or inorganics may be exposed to a process that removes the coating and replaces it with a molecular nanoparticle coating according to embodiments of the present invention. Processes according to these embodiments include the removal of a nanoparticle coating and replacement of that coating with a molecular coating or ligands according to embodiments of the present invention.

Although several etching compositions and processes for etching oxides and/or ceramic coatings from nanoparticles are known, the known processes tend to etch the metal itself, making them unsuitable for removal or oxide coatings from nanoparticles. For nanometric nanoparticles, these processes can lead to unacceptable reduction in mass or complete loss of the nanoparticles. Additionally, the processes are typically water based and tend to be incompatible with organic molecular coatings that are desirable for passivating reactive nanoparticles.

According to embodiments of the invention nanoparticles coated with inorganic oxides or ceramic coatings may be cleaned of the inorganic oxides or ceramic coatings in an etching bath. The etching bath is selected such that when it removes a nanoparticle coating it does not etch the nanoparticle underlying the coating. Furthermore, the etching bath may be selected such that it is compatible with organic solutions. Compatibility with organic solutions facilitates the replacement of inorganic coatings with an organic molecular layer. The etching bath may also be compatible with aqueous solutions.

In some embodiments the etch bath includes water-based baths including an ammonium halide and a non-halide containing acid. Ammonium halides may include ammonium fluoride, ammonium chloride, ammonium bromide, or any combination thereof. The ammonium halide may be present in a concentration of between about 1 and about 99 weight percent and preferably between about 1 and about 10 weight percent. The non-halide containing acid may be present in a concentration of between about 0 and about 100 weight percent and preferably between about 0 and about 5 percent. In addition to ammonium halides, other ammonium salts may be used. Other fluoride or halide salts, such as boron hydrogen fluoride, sodium fluoride, sodium chloride, potassium fluoride, potassium chloride, tetramethylammonium fluoride, tetramethylammonium chloride, tetraethylammonium fluoride, tetraethylammonium chloride, tributylmethylammonium fluoride, tributylmethylammonium chloride, tetrabutylammonium fluoride, tetrabutylammonium chloride, tetra-alkyl ammonium halides, and tetra-aryl ammonium halides may also be used with embodiments of the present invention.

Almost any acid, such as acetic acid, hydrofluoric acid, and/or hydrochloric acid, can work with the embodiments of the present invention. Other non-halide containing acids that may be used with embodiments of the present invention include, but are not limited to, formic acid, propionic acid, benzoic acid, nitric acid, sulfuric acid, phosphoric acid, hydrobromic acid, and citric acid.

In other embodiments the etch bath is a non-aqueous solution. The compositions of non-aqueous etch baths may include compatible halide salt, acid, and organic solvents chosen to be compatible with the desired organic molecular coating. For example, a solution of 1% NH4F and 5% CH3CO2H in 150 ml of propanol is compatible with up to 1 ml of 1-dodecanethiol coating ligand. Use of this composition according to embodiments of the present invention removes the oxide coating an replaces it with a monolayer of dodecanethiol.

In some embodiments it may be necessary to add a second solution to remove all of an inorganic coating from the nanoparticles. The second solution preferably includes a base in a concentration equivalent to quench the acidic etch solution and activate the molecular coating reaction by raising the pH of the etching bath. The addition of a second solution is particularly useful in those instances where the coating ligands require deprotonation to bind to the metal nanoparticle surface.

The etching bath may also include organic solvents compatible with the other bath components. For example, organic solvents such as ethanol, methanol, propanol, isopropanol, butanol, ethylene glycol, propylene glycol, glycerol, water, acetone, methylethylketone, or acetonitrile may be used.

In yet other embodiments, the etching bath can contains a base, an inhibitor, and a coating ligand. The base attacks the oxide or ceramic coating of the particle but is inhibited from attacking the exposed metal of the particle due to the interfering action of the inhibitor. An example of such an etch bath is 1% tetraethylammonium hydroxide and 1% ammoniumperoxodisulfate in ethylene glycol solvent.

Bases that may be used with embodiments of the present invention include, but are not limited to, ammonium hydroxide, sodium hydroxide, potassium hydroxide, tetramethylammonium hydroxide, tetraethylammonium hydroxide, tetrabutylammonium hydroxide, and tetraalkylammonium hydroxide. Inhibitors that may be used with embodiments of the present invention may include, but are not limited to, ammoniumperoxodisulfate, ammonium sulfate, ammonium sulfate, ammonium hydrogensulfate, ammonium hydrogensulfite, and tetraalkylammonium sulfate. Organic ligands that may be used with the embodiments of the present invention include, but are not limited to alkanethiols, alcohols, aromatic thiols, aromatic alcohols, alkane-selenium compounds, alkane carboxylic acids, alkane phosphonic acids, alkane sulfonic acids, aromatic carboxylic acids, and aromatic phosphonic acids. The organic ligands are present in the solution in excess with respect to the nanoparticle surface atoms, and preferably in an excess of at least one-hundred fold.

The etching of oxide coated nanoparticles and application of the coating ligands may be accomplished in a process similar to that illustrated in FIG. 2. The nanoparticles provided from the nanoparticle source 210 nanoparticles coated with an oxide layer or other coating. The coated nanoparticles are introduced to the ligand attachment stage 230. The ligand attachment stage 230 includes an etching solution for etching the coating off of the supplied nanoparticles. According to embodiments of the invention, the etching solution also contains ligands or compounds for forming organic molecular layers that may be used to recoat the nanoparticles. Upon etching or removal of the nanoparticle coating by the etching solution, a new coating is formed on the nanoparticle by the ligands in the etching solution. The newly coated nanoparticles may be separated from the etching solution by known processes.

The following Examples demonstrate various embodiments of the present invention but do not limit the invention to such embodiments:

EXAMPLE 1

Approximately 60 grams of 50 nm diameter aluminum (Al) nanoparticles were stirred into a solution of 1 millimolar (1 mM) dodecanethiol ligand in de-oxygenated heptane solvent. Heptane was de-oxygenated by bubbling argon through the solution for 1 hour. After stirring for 1 hour, the solution was poured over a microporous glass filter and the solid captured as a filter cake on the top of the filter. The solution phase was pulled through the frit with a vacuum applied from the bottom. The filter cake was washed two times with pure heptane to remove any unreacted dodecanethiol ligand, then dried in nitrogen for several hours.

Exposure of the dried powder to air did not result in spontaneous reaction of the aluminum powder. Combustion of the powder by exposure to an open flame was qualitatively similar to aluminum powder passivated with a thin oxide coating.

Figure 3:
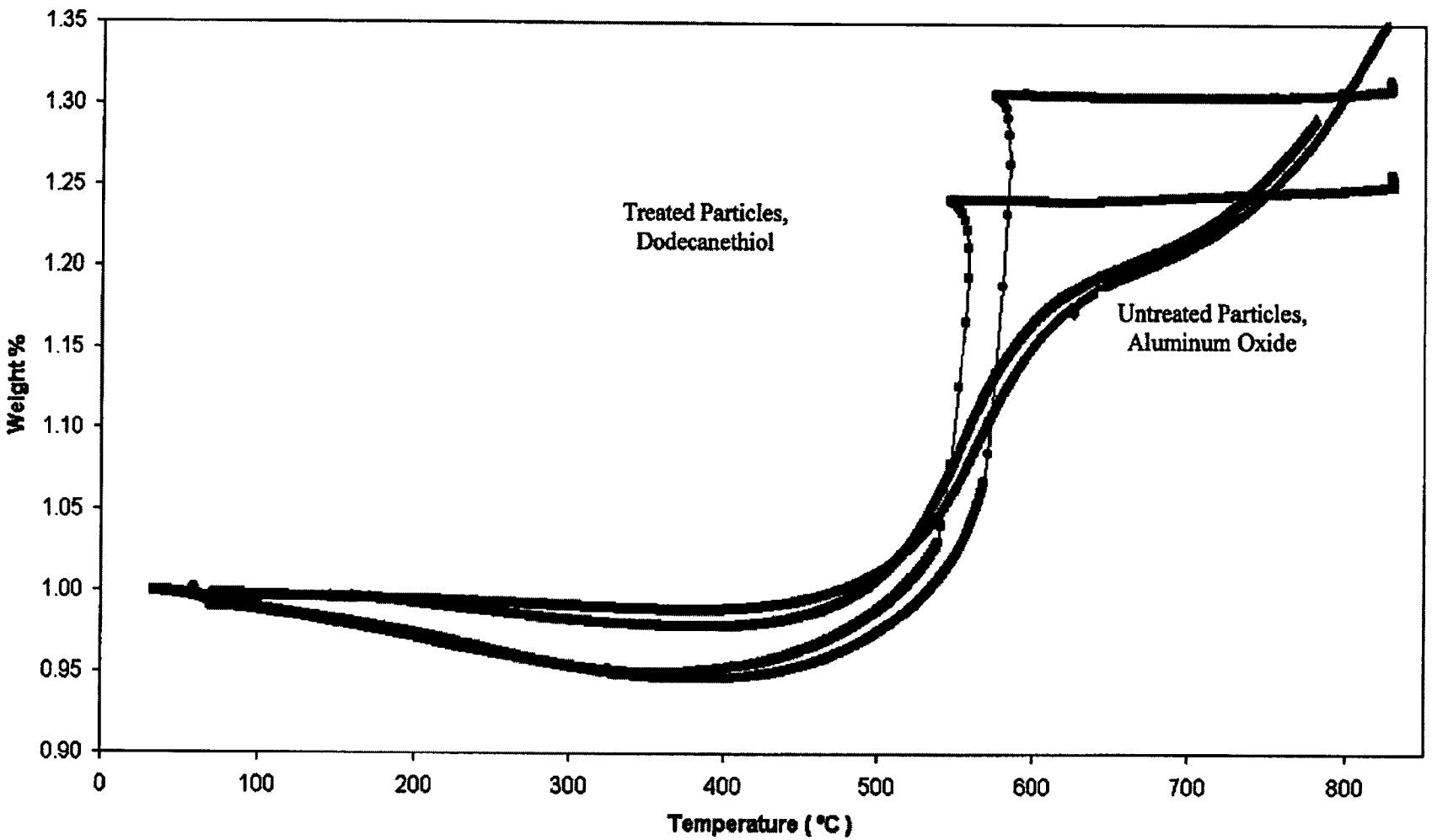
FIG. 3 illustrates a thermogravemetric analysis curve for aluminum oxide samples and dodecanethiol-coated nanoparticles according to embodiments of the present invention.

Thermogravimetric analysis of the sample powders exhibit features indicative of monolayer coatings and accelerated combustion of the aluminum. In this experiment, 9.4983 grams of powder are heated under helium/oxygen gas mixture and the mass of the sample monitored to be reflective of the material's combustion. A thermogravemetric analysis curve for aluminum oxide samples and dodecanethiol-coated nanoparticles according to embodiments of the present invention is illustrated in FIG. 3. The thermal desorption of the dodecanethiol monolayer is seen in the mass reduction at approximately 100° C. The mass decrease of approximately 2% corresponds to $9.44\times10^{-4}$ moles of ligand in the sample. For the estimated particle size, the calculated amount of ligand present should be $8.92\times10^{-4}$ moles (assuming area/molecule of $7.18\times10^{-19}$ $m^2$ and particle surface area of $7.85\times10^{-15}$ $m^2$; the sample contains approximately $5.38\times10^{16}$ particles).

The second feature indicative of accelerated combustion is the rapid increase in mass at 500° C., due to the reaction of the aluminum with oxygen, resulting in the formation of $Al_2O_3$. The reaction occurs faster than the instrument can keep up, causing the discontinuity of the curve seen in the middle portion. This is in stark contrast to the response seen in an oxide coated particle, where the mass increase is smooth and much slower. Also note that the reaction temperature (as indicated by the inflection point of the steep rise) occurs at a much lower temperature for the dodecanethiol coated particles (about 500° C.) versus the oxide-coated material (about 550° C.).

EXAMPLE 2

A solution of 1 gram of ammonium fluoride, 10 grams of acetic acid, and 89 grams of distilled water was prepared in a polyethylene beaker with a Teflon-coated magnetic stirbar. Under stirring of the solution, 1 gram of 80 nm diameter aluminum nanoparticles coated with a 2 nm thick shell of aluminum oxide passivating layer were added. In less than one minute, small gas bubbles were observed in the solution, indicating that the oxide layer was being etched. The process was complete within several minutes, as evidenced by the cessation of gas evolution. The appearance of the solution changed from relatively large suspended particles of powder to a finely divided, colloidal solution that remained stable for many days.

EXAMPLE 3

A solution was prepared in a polyethylene container consisting of 1 gram of ammonium fluoride, 5 grams of acetic acid, and 139 grams of isopropanol. The solution was stirred as in the previous example and 1 gram of 80 nm diameter oxide passivated aluminum nanoparticles was added. The solution was allowed to stir for 12 hours during which time no hydrogen gas evolution was observed. A second solution of 3.33 grams of KOH (potassium hydroxide) in isopropanol was added rapidly to the stirred solution, evoking the generation of gas bubbles that quickly subsided. This mixture was allowed to stir for several hours, at which time it was observed to separate into a dark gray oily (minor) fraction containing the nanoparticles below a clear (major) fraction. The clear fraction of the solution was decanted and the dark gray fraction washed with 50 milliliters of n-heptane. The solubility of the nanoparticles in n-heptane confirms their coating with an organic layer of isopropoxide.

EXAMPLE 4

A solution was prepared in a polyethylene beaker consisting of 1 gram of ammonium fluoride, 5 grams of acetic acid, 500 microliters of 1-dodecanethiol and 139 grams of isopropanol. The solution was stirred as in the previous two examples and 1 gram of 80 nm diameter oxide passivated aluminum nanoparticles was added. The solution was allowed to stir for 8 hours during which time, no hydrogen gas evolution was observed. 0.5 grams of triethylamine were added by pipette to the stirred solution, evoking rapid generation of gas bubbles that subsided quickly. This mixture was allowed to stir for several hours, at which time it was observed to separate into a dark gray oily (minor) fraction containing the nanoparticles below a clear (major) fraction. The clear major fraction was decanted and the dark gray fraction washed with 50 milliliters of n-heptane. The solubility of the nanoparticles in n-heptane confirms their coating with an organic layer of dodecanethiol.

Figure 4A:
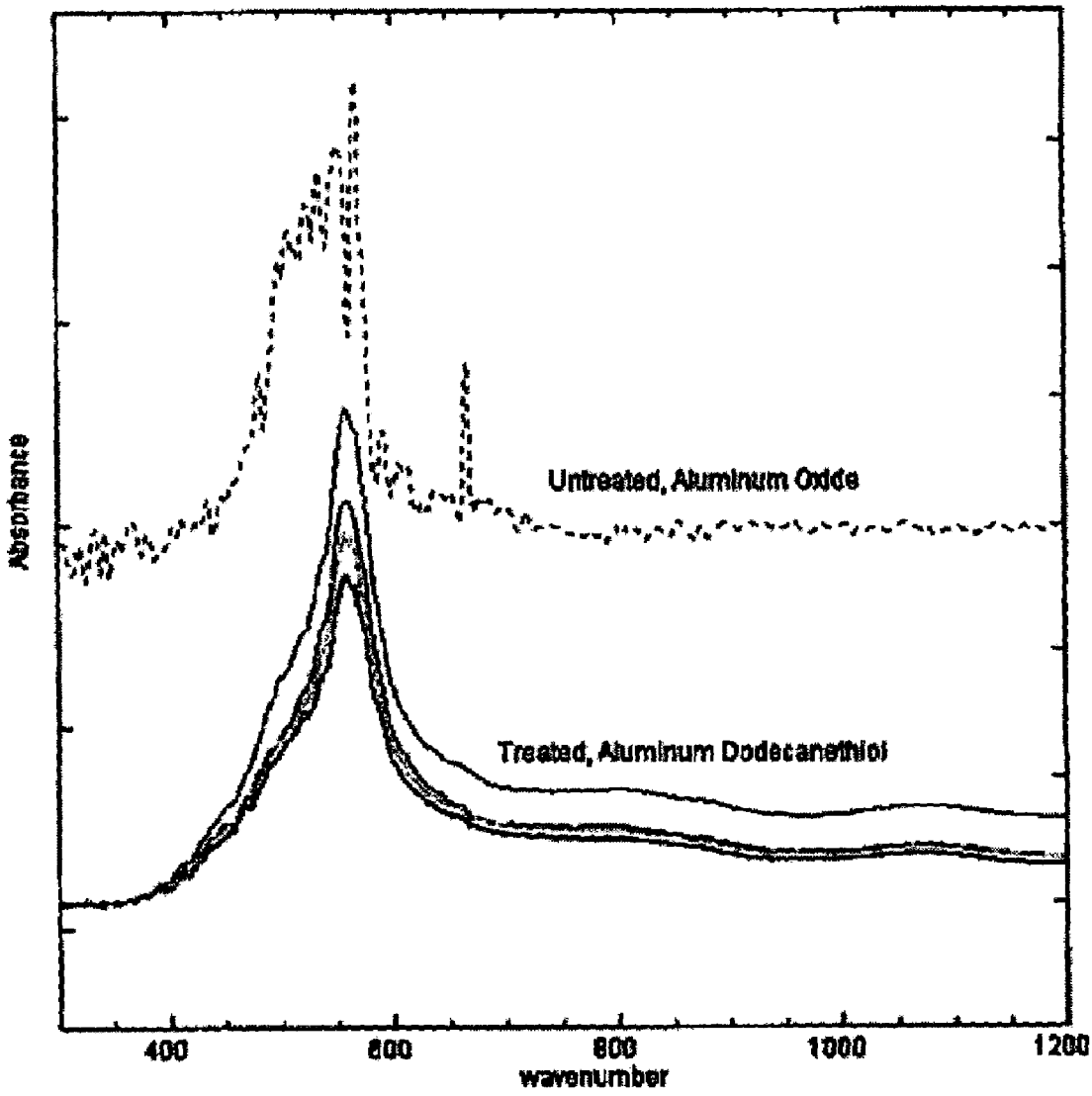
FIGS. 4(A) and 4(B) illustrate wavelength spectrums for oxide coated aluminum nanoparticles and organically coated aluminum nanoparticles according to embodiments of the present invention
Figure 4B:
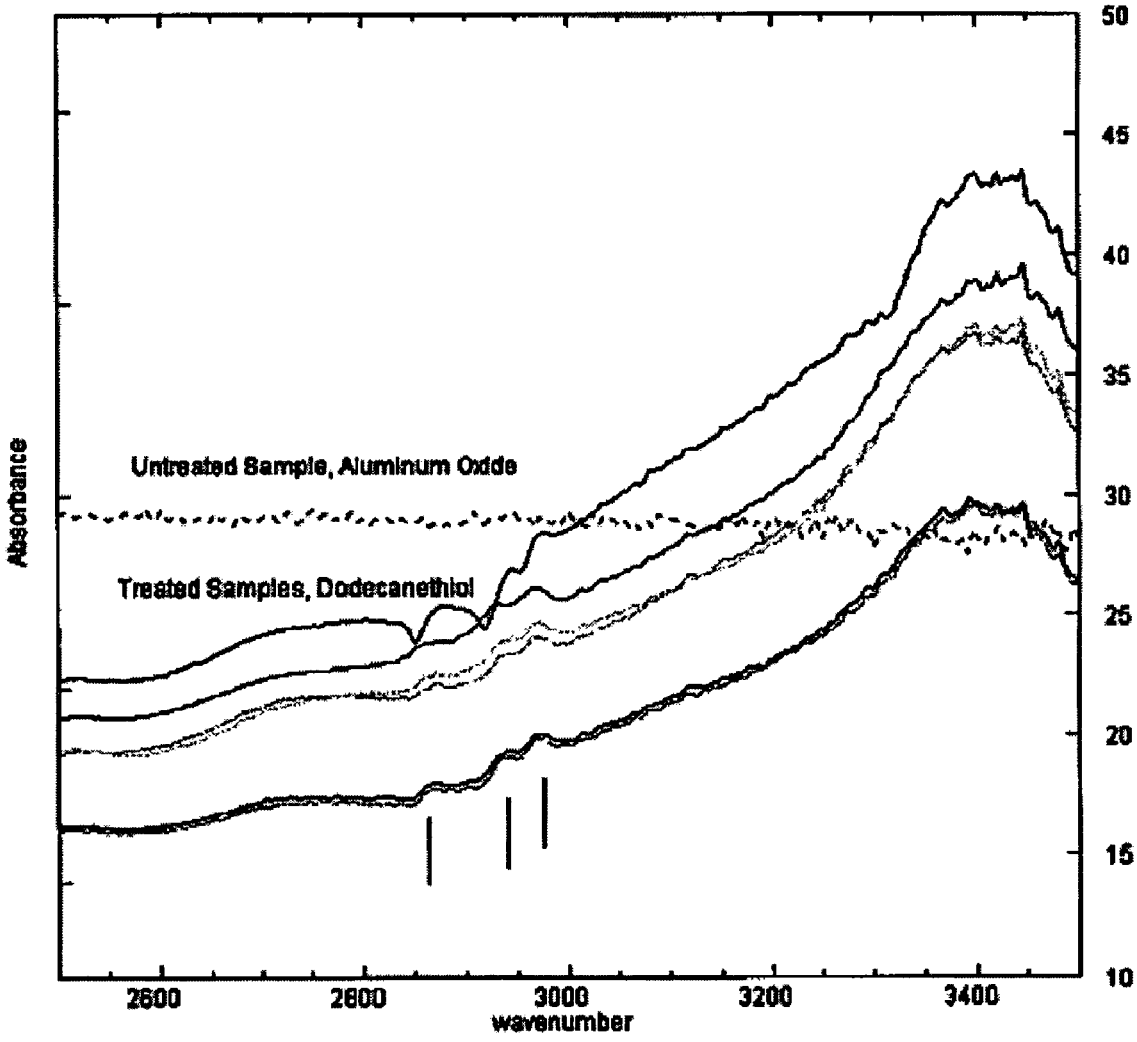

FIGS. 4(A) and 4(B) illustrate infrared spectrums of oxide coated nanoparticles and coated nanoparticles according to embodiments of the present invention. The spectrums demonstrate that the oxide coating about the oxide passivated aluminum nanoparticles in the above examples is replaced with organic coatings according to embodiments of the present invention. FIG. 4(A) displays an infrared spectrum from 300 to 1200 wavenumbers and FIG. 4(B) displays an infrared spectrum from 2500 to 3500 wavenumbers. The tracing for oxide coated aluminum particles is shown in a dotted line in both figures. The other lines in the figures illustrate the tracings for coated nanoparticles formed according to embodiments of the present invention. As illustrated, the oxide coated particles display an absorption band at 667 wavenumbers, which is not present in the tracings for the coated nanoparticles formed according to embodiments of the present invention. That absorption band corresponds to the aluminum oxide stretching frequency of the oxide coating on the nanoparticles. The spectrum illustrated in FIG. 4(B) displays the region of the spectra that corresponds to the C—H stretching of dodecanethiol. The nanoparticles coated according to embodiments of the present invention display absorbance bands at 2867, 2934, and 2972 wavenumbers, which correspond to the presence of dodecanethiol monolayers on the particles. The presence of these absorbance bands and the lack of an absorbance band in the range of an aluminum oxide stretching frequency demonstrates that the coated nanoparticles formed according to embodiments of the present invention are coated with dodecanethiol rather than an aluminum oxide layer.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A reactive nanoparticle, comprising:

a nanoparticle; and a reactive organic molecular coating covalently bound to said nanoparticle, wherein the organic molecular coating comprises an explosive or a propellant.

2. The reactive nanoparticle of claim 1, wherein said nanoparticle is selected from the group consisting of aluminum, molybdenum, zirconium, silicon, magnesium, calcium, arsenic, gallium, copper, iron, titanium, phosphorus, boron, sodium, and potassium.

3. The reactive nanoparticle of claim 1, wherein said organic molecular coating surrounding said nanoparticle comprises an explosive.

4. The reactive nanoparticle of claim 3, wherein said explosive comprises an explosive selected from the group consisting of TNT, Tetryl, RDX, and PETN.

5. The reactive nanoparticle of claim 1, wherein said organic molecular coating covalently bound to said nanoparticle comprises a propellant.

6. The reactive nanoparticle of claim 1, wherein said organic molecular coating covalently bound to said nanoparticle comprises a photoinitiator.

7. The reactive nanoparticle of claim 1, wherein said organic molecular coating covalently bound to said nanoparticle comprises a molecular coating that releases an oxygen singlet upon reaction.

8. The reactive nanoparticle of claim 1, wherein said organic molecular coating covalently bound to said nanoparticle comprises a polar molecular coating.

9. The reactive nanoparticle of claim 1, wherein said organic molecular coating covalently bound to said nanoparticle comprises a non-polar molecular coating.

10. The reactive nanoparticle of claim 1, wherein said organic molecular coating covalently bound to said nanoparticle comprises molecules of the organic coating having a binding end with an affinity for the surface of said nanoparticle.

11. The reactive nanoparticle of claim 10, wherein said binding ends having an affinity for the surface of said nanoparticle comprise binding ends selected from the group consisting of nitrile, sulfate, phosphonate, phosphate, phosphine, isonitrile, nitro, carboxylate, alcohols, and seleno moieties.

12. The reactive nanoparticle of claim 1, wherein said organic molecular coating covalently bound to said nanoparticle comprises an organic molecular coating designed to react with said nanoparticle at a predetermined temperature.

13. The reactive nanoparticle of claim 1, wherein said organic molecular coating covalently bound to said nanoparticle comprises an organic molecular coating designed to react with said nanoparticle at a predetermined condition.

14. The reactive nanoparticle of claim 1, wherein said reactive nanoparticle comprises a metal selected from the group consisting of aluminum, molybdenum, zirconium, silicon, magnesium, calcium, arsenic, gallium, copper, iron, titanium, phosphorous, boron, sodium, and potassium, and wherein the removal of organic molecular coating covalently bound to said nanoparticle comprises an exergonic reaction.

15. The reactive nanoparticle of claim 1, wherein said nanoparticle is contained in a fuel and increases the rate of combustion of the fuel.

16. The reactive nanoparticle of claim 1, wherein said organic molecular coating covalently bound to said nanoparticle increases the energy density of said nanoparticle.

17. The reactive nanoparticle of claim 1, wherein said nanoparticle is contained in a reactive composition and wherein said organic molecular coating covalently bound to said nanoparticle increases the rate of reaction of said reactive composition.

18. A propellant composition comprising:
a propellant; and
at least one reactive nanoparticle of claim 1.

19. An explosive composition comprising:
an explosive; and
at least one reactive nanoparticle of claim 1.

20. A fuel composition comprising:
a fuel; and
at least one reactive nanoparticle of claim 1.

21. A fuel composition comprising:
a fuel; and
at least one reactive nanoparticle of claim 1 wherein said nanoparticle increases the energy released by the combustion of said fuel composition.

22. A liquid fuel composition comprising:
at least one liquid fuel; and
at least one reactive nanoparticle of claim 1.

23. A liquid fuel composition comprising:
at least one liquid fuel selected from the group consisting of heptane, propanol, and diethyl ether; and
at least one reactive nanoparticle of claim 1.

24. A composition comprising:
at least one reactive nanoparticle of claim 1, and
a composition selected from the group consisting of a fuel, a propellant, and an explosive.

25. A reactive nanoparticle, comprising:
a metal nanoparticle; and
a reactive polymeric ligand monolayer shell covalently bound to said metal nanoparticle, wherein the monolayer shell comprises an explosive or a propellant.

26. The reactive nanoparticle of claim 25, wherein said metal nanoparticle is selected from the group consisting of aluminum, molybdenum, zirconium, silicon, magnesium, calcium, arsenic, gallium, copper, iron, titanium, phosphorus, boron, sodium, and potassium.

27. The reactive nanoparticle of claim 25, wherein said polymeric ligand monolayer shell comprises an explosive.

28. The reactive nanoparticle of claim 27, wherein said explosive is selected from the group consisting of TNT, Tetryl, RDX, and PETN.

29. The reactive nanoparticle of claim 25, wherein said polymeric ligand monolayer shell comprises a propellant.

30. The reactive nanoparticle of claim 25, wherein said polymeric ligand monolayer shell comprises a photoinitiator.

31. The reactive nanoparticle of claim 25, wherein said polymeric ligand monolayer shell comprises a ligand that releases an oxygen singlet upon reaction.

32. The reactive nanoparticle of claim 25, wherein said polymeric ligand monolayer shell comprises ligands having a binding end with an affinity for the surface of said metal nanoparticle.

33. The reactive nanoparticle of claim 32, wherein said binding ends having an affinity for the surface of said metal nanoparticle comprise binding ends selected from the group consisting of nitrile, sulfate, phosphonate, phosphate, phosphine, isonitrile, nitro, carboxylate, alcohols, and seleno moieties.

34. The reactive nanoparticle of claim 25, wherein said polymeric ligand monolayer shell disassociates from said metal nanoparticle at a predetermined temperature.

35. The reactive nanoparticle of claim 25, wherein said polymeric ligand monolayer shell comprises a polymeric ligand monolayer incorporating a subgroup selected from the group consisting of explosive compounds, nitro compounds, azido compounds, peroxides, and alkynes.

36. A propellant composition comprising:
a propellant; and
at least one reactive nanoparticle of claim 25.

37. An explosive composition comprising:
an explosive; and
at least one reactive nanoparticle of claim 16.

38. A fuel composition comprising:
a fuel; and
at least one reactive nanoparticle of claim 25.

39. A liquid fuel composition comprising:
a liquid fuel; and
at least one reactive nanoparticle of claim 25.

40. A liquid fuel composition comprising:
at least one liquid fuel selected from the group consisting of heptane, propanol, and diethyl ether; and
at least one reactive nanoparticle of claim 25.

* * * * *

UNITED STATES PATENT AND TRADEMARK OFFICE

CERTIFICATE OF CORRECTION

PATENT NO. : 7,338,711 B1
APPLICATION NO. : 10/639669
DATED : March 4, 2008
INVENTOR(S) : Louis Brousseau, III It is certified that error appears in the above-identified patent and that said Letters Patent is hereby corrected as shown below:

In Column 13, Line 7, Claim 3, please replace "surrounding" with --covalently bound to--

Signed and Sealed this

Nineteenth Day of August, 2008

JON W. DUDAS
*Director of the United States Patent and Trademark Office*